US006286855B1

(12) United States Patent
Paris

(10) Patent No.: US 6,286,855 B1
(45) Date of Patent: Sep. 11, 2001

(54) FOOTWEAR SUCH AS A SKI BOOT OR THE LIKE, AND SKI OR THE LIKE FOR USE THEREWITH

(75) Inventor: Jean-Francois Paris, Servrier (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/147,366

(22) PCT Filed: Jan. 7, 1997

(86) PCT No.: PCT/FR97/00025

§ 371 Date: Dec. 9, 1998

§ 102(e) Date: Dec. 9, 1998

(87) PCT Pub. No.: WO97/26959

PCT Pub. Date: Jul. 31, 1997

(30) Foreign Application Priority Data

Jan. 22, 1996 (FR) ..... 96/00831

(51) Int. Cl.[7] ..... A63C 9/08

(52) U.S. Cl. ..... 280/611; 280/608; 280/14.2; 36/117.4

(58) Field of Search ..... 280/14.2, 611, 280/618, 607, 634; 36/115.4, 141, 117.4, 119.1, 50.1

(56) References Cited

U.S. PATENT DOCUMENTS

| | | | | |
|---|---|---|---|---|
| 3,955,825 | * | 5/1976 | Kubelka et al. | 280/618 |
| 4,078,322 | * | 3/1978 | Dalebout | 36/121 |
| 4,747,221 | * | 5/1988 | Hayes | 36/119 |
| 4,945,659 | * | 8/1990 | Marchi et al. | 36/117 |
| 5,170,574 | * | 12/1992 | Weisbrich | 36/136 |
| 5,199,726 | * | 4/1993 | Willett | 280/611 |
| 5,393,077 | | 2/1995 | Wanous | 280/7.13 |
| 5,411,278 | | 5/1995 | Wittmann | 280/11.22 |
| 5,461,801 | * | 10/1995 | Anderton | 36/50.1 |
| 5,475,936 | | 12/1995 | Cavasin | 36/115 |
| 5,938,228 | * | 8/1999 | Bourdeau | 280/607 |
| 6,017,042 | * | 1/2000 | Paris | 280/14.2 |

FOREIGN PATENT DOCUMENTS

| | | |
|---|---|---|
| 507007 | 6/1971 | (CH) . |
| 0167765 | 1/1986 | (EP) . |
| 2305208 | 10/1976 | (FR) . |
| 2350854 | 12/1977 | (FR) . |
| 2533448 | 3/1984 | (FR) . |
| 2654591 | 5/1991 | (FR) . |
| 2659534 | 9/1991 | (FR) . |
| 2679781 | 2/1993 | (FR) . |
| WO 91/16957 | 11/1991 | (WO) . |

* cited by examiner

*Primary Examiner*—Michael Mar
*Assistant Examiner*—Hau Phan
(74) *Attorney, Agent, or Firm*—Greenblum & Bernstein, P.L.C.

(57) ABSTRACT

Sports footwear such as a boot comprising a rigid base (2) and an upper (3), and engageable with a ski or the like (6) on which the boot is to be supported and retained, while also enabling walking under favourable conditions. The boot is provided with a walking sole and comprises bearing surfaces (12, 13) recessed into the rigid base relative to the sole surface. The bearing surfaces (12, 13) are engageable, directly or via a cradle (7), with the top surfaces of projections (16, 17) on the ski, whereby the boot/ski and boot/ground interfaces are separate.

24 Claims, 8 Drawing Sheets

X2
9
2
3
11
1b
17
13
X
X'
7
1a
16
12
X1
10
6
8

FOOTWEAR SUCH AS A SKI BOOT OR THE LIKE, AND SKI OR THE LIKE FOR USE THEREWITH

BACKGROUND OF THE INVENTION

1. Field of the Invention

The invention relates to boots adapted to be used for athletic practices in association with a gliding apparatus, for example, for sports on snow, or ice, skiing, or with a rolling apparatus, for example, in-line roller skates in which the boot portion is separable from the apparatus. The term gliding apparatus will hereinafter designate apparatuses that are strictly gliding as well as those equipped with wheels.

1. Description of the Background and Relevant Information

For the aforementioned types of sports, the boot is affixed to the apparatus during practice, with supports allowing the athlete to steer the apparatus, and retaining means to hold the feet on the apparatus.

When the athlete stops, he "removes the boot," i.e., he disengages the apparatus from the boots in order to be able to walk, and the object in these stopping phases is to have a boot allowing as normal a walk as possible.

However, and this is especially the case for alpine skiing, given that the bindings and the boots cooperate to ensure the skier's safety, the soles must have a set of geometric features and predefined qualities of friction. These requirements are specified for alpine skiing in the ISO 5355 standard.

Walking during the stopping phases cannot therefore occur in safety and comfort conditions worthy of the progress achieved elsewhere. With respect to walking comfort, one must consider a sole correctly designed for this function, i.e., having a shape allowing the movement of the foot and a material ensuring adherence and a certain shock absorption.

Additionally, since the ski boot is consistent with the standard requirements when it is put out on the market, the skier can think that his equipment will always be efficient and reliable. However, after a few hours of being used for walking, the quality of the sole/binding linkage can decrease substantially. The reasons are numerous: a wedge of snow under the boot when putting the ski on, dirt and incrustations in the sole, degradation in the normalized zones by wear due to walking, a poor adjustment induced, etc.

Finally, during athletic practice, the boot/binding assembly must ensure the transmission of forces from the skier to the ski. In the best current embodiments, the polygon formed by the boot/binding contact zones is of such a dimension that, associated with a sole worn and curved from walking, the assembly lends itself to a "hinge effect" due to the curving, all the more substantial since the binding adjustment is low.

The result is a decrease in the ski steering accuracy, which can cause the skier to increase the release values recommended for the binding adjustment in order to avoid ill-timed releases and to reconstitute the conditions of a good ski steering accuracy. Furthermore, to overcome this drawback, the boot manufacturer is led to raise and stiffen the boot upper, which translates into a lesser comfort and the rise of the traumatic risk towards the knee.

Current statistics confirm the phenomenon.

To answer this series of problems in part, the manufacturers have envisioned two lines of progress pertaining to the so-called safety binding.

The first consists in compensating for the degradation of the normalized surfaces of the boot by reducing the relative movement between the binding and the boot or with mechanisms creating punctual slackness of the abutment, avoiding "wedging" effects, therefore the increase in the release values. These solutions have little effect in the presence of an accentuated wear of the sole due to walking, and/or penalize the transmission of forces from the skier to the ski by installing an elasticity that "limits" these forces and by accentuating the previously mentioned "hinge effect." Another drawback is that this technique can cause ill-timed releases by offering a release value that is too low in certain fall configurations not indexed by the standard. The user is still tempted to increase his binding adjustments, which ruins the adjustment optimization effort by the manufacturer and puts himself in a dangerous position.

The second line consists in proposing so-called "plate" bindings. Two concepts emerged in this field, namely the plates affixed to the boot during the release and those remaining affixed to the ski under the same circumstances.

The first are described, for example, in the commonly owned patent FR 2 350 854, which discloses separating the "king" interface from the one cooperating with the binding; however, there are still drawbacks. Indeed, if one wishes to give a "walking" profile to the sole, the boot becomes "bastardized" and implies the simultaneous purchase of the boot, the plate and a "plate/ski" linkage system. This economic handicap has not enabled the development of this concept.

Another drawback is that the seating of the boot on the plate becomes unstable as soon as snow gets in between the plate and the sole of the boot, or as soon as the latter is worn and rounded off from walking, as mentioned previously. The problem with the ski steering accuracy due to the "hinge effect" described hereinabove therefore remains in its entirety.

Still another drawback is that in the case of a release on a steep icy slope, the plate remaining affixed to the boot becomes a handicap with respect to adherence and walking in recuperating his ski or skis.

The second ones were progressively called "boots/bindings." The plate portion, affixed to the ski and generally comprising the release system, cooperates with specific shapes integrated with the sole of the boot.

Such constructions are described in the FR 2 305 208, FR 2 533 448 and CH 507 007.

In the first patent FR 2 305 208, the wear of the sole and the accumulation of snow promoted by the walking profile leaves intact the problem of ski steering accuracy, due to the previously mentioned "hinge effect." Furthermore, the economical handicap remains in its entirety, the boot being able to cooperate only with the appropriate binding, and inversely. Finally, this type of mechanism has never been able to approximate, if not equal, the qualities of the abutment/heel concept.

In the second patent FR 2 533 448, the economical aspect is not questioned, the boot being capable of using the commercially available conventional bindings. The same goes for the instantaneous rotation center located plumb the tibia and fairly constant. Nevertheless, major handicaps have led to the abandonment of this concept, namely:

- the blind fitting of the boot: the narrowness of the alpine ski and its mobility under the least impact makes the fitting almost impossible in many cases (rugged ground, slopes, etc.),
- the relationship between the plate and sole dimensions: indeed, if the dimension of the plate is sufficiently reduced to receive small sizes while preserving the normalized ends, it follows, especially in large sizes, a very disturbed longitudinal stability however little the sole is raised with respect to the ski. In this case, with the help of the binding elasticity, the release values will vary depending on the supports of the sole ends on the ski, these variables depending on the sizes and the presence or not of a wedge of snow, finally, the dimensions of the polygon formed by the previously described boot/plate contact zones are too reduced to ensure a correct transmission of the forces, in the transverse direction as much as in the longitudinal.

As for the solution proposing several plate dimensions to cover all of the sizes, the cost is high, since the entire release mechanism, as well as the boot, are affected.

Finally, in various constructions of the "boots/bindings" type, at least a part of the walking surface of the sole is also the support surface on the ski or the binding. Here again, wear and deformations are incompatible with performance and safety. Commonly owned patent FR 2 654 591 shows this description.

In the third patent CH 507 007, a boot suspended at the front and rear ends on an abutment and a heel, respectively, is disclosed. This construction has been abandoned for several reasons:

it implies an extremely rigid sole given the distance of the supports (structure, cost, weight, etc.), the protuberances at the front and rear of the boot are exposed to impacts (the ends in particular are exposed), going up or down stairs, etc., since all of the forces are reflected directly to the binding (in particular, the abutment), it is understood that the functioning of the latter is disturbed by a variable weight (transfer of weight due to imbalances), fitting becomes extremely difficult, even impossible, if one wishes to take advantage of the raised position of the sole with respect to the ski, finally, the cost of an inseparable assembly is high.

Ski boots are also known whose shell comprises, at its lower portion, profiled notches adapted to the front and rear binding of the shell with respect to a rotative plate. These notches do not constitute support surfaces, but only retaining members replacing those existing in the ISO 5355 standard. The support remains the lower surface of the sole, therefore the "walking" surface.

SUMMARY OF THE INVENTION

An object of the present invention is to overcome the various drawbacks previously enumerated by proposing a boot offering both good walking features and good features for athletic practice, as much for the supports allowing the steering of the apparatus as for the retention on the apparatus, and this in a durable manner, the support zones being outside of the wear zones of the sole.

In addition, the boot according to the invention can, in an embodiment, be compatible with the use of a normalized sole structure adapted to cooperate with bindings having conventional retentions and supports.

An object of the invention is a boot for gliding sports comprising a rigid base and an upper adapted to cooperate with a gliding apparatus on which the boot must take supports and be retained, wherein the base is equipped with a sole and comprises support surfaces recessed with respect to the surface of the bearing sole when walking, these support surfaces defining a support plane and being adapted to take support on the upper surfaces of the projections extending from the gliding apparatus, the boot furthermore comprising detachable retaining elements to cooperate with complementary retaining elements fixed to the gliding apparatus.

The invention also has the object of a snow gliding apparatus comprising a gliding element equipped with retaining elements adapted to cooperate with at least one boot, the gliding apparatus comprising a cradle equipped with projections whose upper surfaces define a support plane for the boot, the cradle having a base fixed to the gliding apparatus to transmit the boot supports to the apparatus.

BRIEF DESCRIPTION OF THE DRAWINGS

The invention will be better understood and other features will appear in the following description, with reference to the attached drawings.

DETAILED DESCRIPTION OF THE INVENTION

To better understand the following description, it is necessary to define what is meant by "supports" and "retentions" when skiing, for example.

The support zones are the zones of the boot that define the polygon for supporting the boot on the element beneath it (binding, ski or intermediate element of the plate type).

The retaining zones are the zones that cooperate with parts of the binding to retain the boot on the latter during various biases when skiing.

Conventionally, the supports are obtained by the sole taking support on the ski and through the retaining elements which are the abutments and heels. According to the invention, they are separate as it will appear from the following description.

Figure 1:
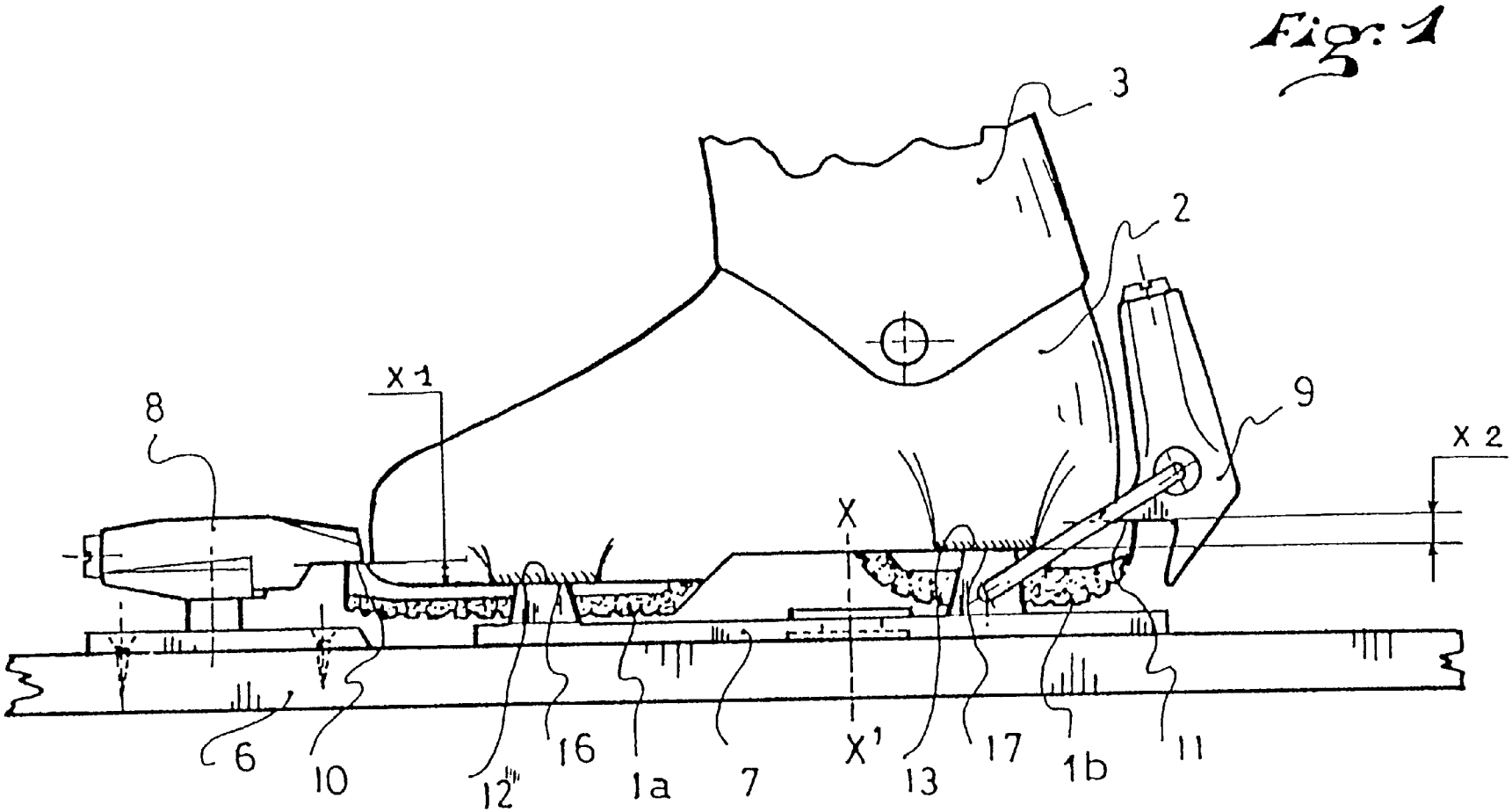
FIG. 1 shows a lateral view of a first embodiment of a boot for gliding sports according to the invention for alpine skiing, associated with a specific conventional binding device and a specific support device.

FIG. 1 shows a first embodiment wherein the gliding apparatus is an alpine ski and the boot is a rigid shell alpine ski boot.

The boot shown in FIG. 1 is constituted by an external sole 1 made of two parts 1*a* and 1*b*, which will be discussed later, and from which a rigid shell base 2 extends, itself overlaid by an upper 3.

The boot is adapted to cooperate with a ski 6, by means of a binding device that comprises front and rear fastening members 8 and 9 cooperating with zones 10 and 11, respectively, for the vertical retention of the boot. These retaining zones 10 and 11 are engaged, preferably in a conventional manner, at the front and rear ends of the sole 1.

According to the invention, the boot furthermore comprises support surfaces 12, 13 (and 14 and 15, not shown in this lateral view) for the boot on the ski, on both sides of the lateral flanks of the shell base 2, in a zone extending beyond the width of the normalized contour of the sole 1, these supports being retracted from the plane of the lower surface of the sole 1.

These support surfaces 12 and 13 of the boot cooperate with corresponding support surfaces 16 and 17 (18 and 19 are not shown) obtained at the tops of four vertical projections extending from a contact plate fixed to the ski 6 and forming a cradle 7 attached thereon.

This cradle 7 affixed to the ski 6 and also bearing the rear binding element 9 is at least partially rotative with respect to the ski. Preferably, the cradle 7 is rotatably mounted on the ski along a rotation axis XX' located between the rear of the calcaneus and the first metatarsal of the skier's foot. These support surfaces 16 and 17 are raised sufficiently with respect to the upper plane of the ski or of the binding assembly in order to allow the raising of the walking surfaces 1*a* and 1*b* of the sole, to guarantee the priority of the supports 12, 14, 13, 15 and 16, 18, 17, 19, and finally to allow a "wedge of snow" under the sole.

Figure 2:
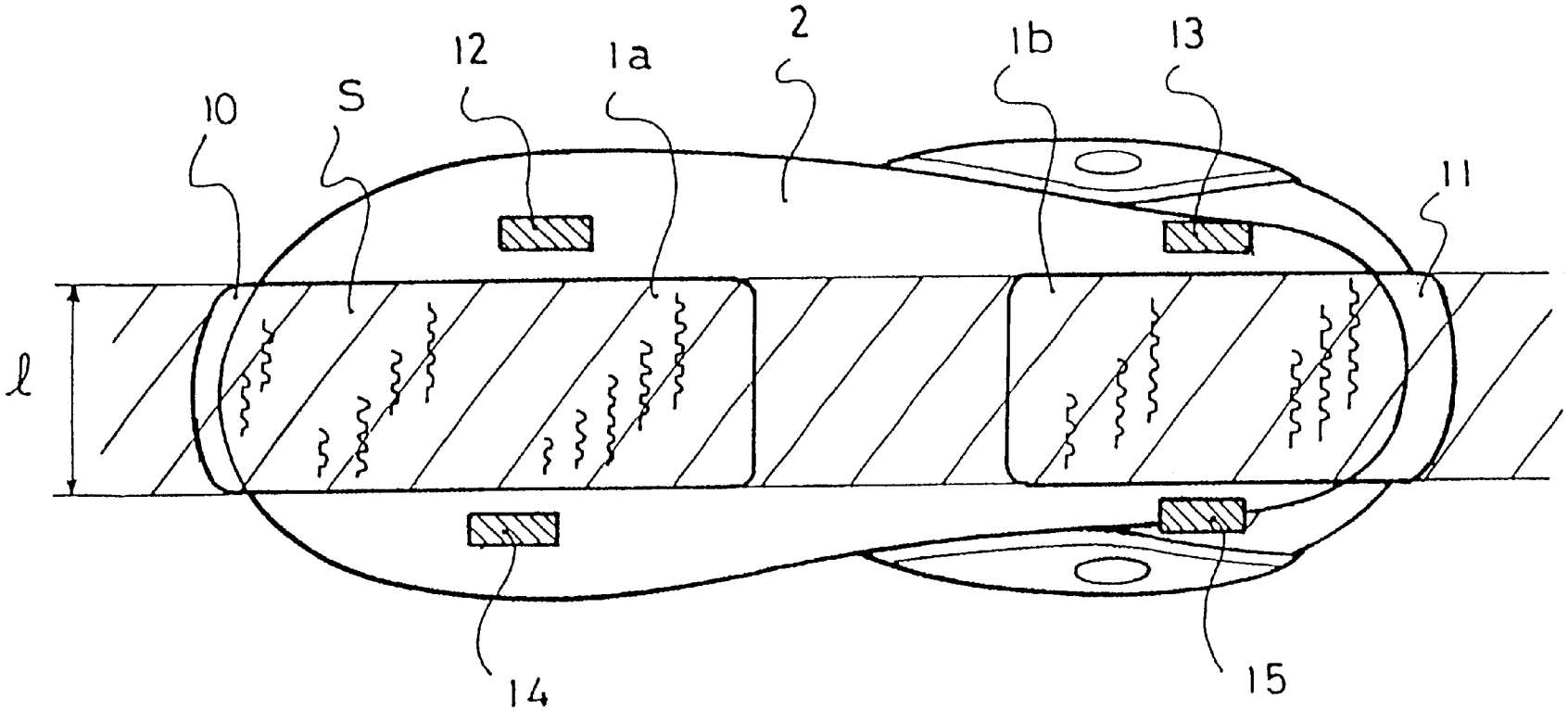
FIG. 2 shows a bottom view of the shell of the boot according to FIG. 1.

FIG. 2 shows in a bottom view the boot of FIG. 1, especially the sole/walking surface zone 1*a*, 1*b*, within a having a width "l" corresponding to the normalized zone (ISO 5355 standard) of the sole 14.

The support surfaces of the gliding apparatus under the boot 12, 13, 14, 15 are visible in the drawing. They are recessed in height with respect to the walking surface "S," and on both sides of this sole. They are engaged on the bottom of the shell 2.

In one embodiment these support surfaces 12, 13, 14, 15 can be constituted of cleats obtained from molding with the shell base 2. Of course, these cleats can also be attached to or associated with mounting tabs inserted between the shell 2 and the sole 1.

According to a preferred feature of the invention, the front support surfaces 12, 14 are located under the metatarsal articulation, and the rear support surfaces 13, 15 are located under the heel, in order to achieve a good compromise between a longitudinal stability of the boot 1 on the cradle 7 and a desired rigidity of the shell base 2.

The dimensions between, on the one hand, the front support surfaces 12 and 14 and the front retaining surface 10 (×1) and, on the other hand, the rear support surfaces 13, 15 and the rear retaining surface 11 (×2) are specified during construction and make any "height adjustment" of the binding unnecessary, a source of forgetfulness and therefore of insecurity in prior systems.

Additionally, the respective lengths of the front and rear support surfaces of the boot are sufficient to allow a support for boots of different sizes on a standard cradle 7.

It is possible to create an advancing and/or canting effect with such a structure. For this, the supports formed between the support surfaces 12, 13, 14, 15 of the boot and the corresponding support surfaces 16, 17, 18, 19 of the cradle 7 are offset in height with respect to one another to form the desired support plane.

The tilting of these planes can also be adjustable.

Preferably, the fastening member 9 of the rear part of the binding commonly called "heel" is loaded on the cradle as shown in FIG. 1. However, it could be independent and affixed directly to the ski 6 however little it allows the rotation of the boot from the pivot around XX' (FIG. 1).

The front fastening member or abutment 8 will be preferably affixed in a conventional manner to the ski 6 to maintain all of its functionalities. As for safety, the advantages come out immediately. The supports 12, 13, 14 and 15 cooperating with the projections 16–19 are stable, independent of the wear of the sole 1 and located in a zone that avoids wedges of snow and aggressions.

The invention also relates to the association of the boot, such as described, with the support device formed by the cradle 7 which in fact replaces the conventional supports (through the fastening elements which are the abutments and heels), and therefore allows the separating of support surface and walking surface.

Walking with a sole adapted for walking becomes sure and comfortable without having any negative effect on safety when skiing.

The presence of a pivot (around XX') located anatomically between the rear of the calcaneus and the first metatarsal authorizes an optimum functioning of the abutment and the best possible control of the release values, including in the particular configurations with a presence of lateral moment. The traumatic risk of the knee is therefore substantially reduced.

In summary, safety is maintained, independently of the weather, wear, dirt and instantaneous center of rotation of the boot, practically undetermined in the conventional abutment/heel concept.

As for performance, the quality and dimensions of the support polygon guarantee an optimum transmission of the forces from the skier to the ski by considerably reducing the "hinge effect" previously described. In addition, the distance with respect to the longitudinal axis of the ski (and of the boot) of the supports 12, 13, 14, 15 bring the latter substantially plumb with the running edges of the ski and make the edge setting optimal. This arrangement has favorable effects on safety and comfort.

Indeed, it can allow, at an equal transmission quality, the construction of a boot upper 3 that is more flexible, even lower, than what must be constructed in conventional alpine boots. There, too, the risk of traumatism at the level of the knee decreases, and the opportunity to correctly deal with the boot comfort is also available.

Finally, the better transmission of the forces and stability of the boot/binding/ski structure allow skiing at a lower value of binding adjustment.

In summary, the described construction provide for excellent safety that is reliable in weather conditions, improved performance and walking comfort compatible, qualities which were incompatible in the conventional structures.

The invention as it appears from the previous description is applicable to types of athletic practices other than alpine skiing.

In particular, any athletic practice in which a boot is associated with a gliding (or rolling) apparatus on which it is held by retaining elements, and which requires the transmission through supports on the apparatus can use a boot of this type with a walking sole and support surfaces recessed with respect to the sole surface to cooperate with raised support surfaces coming from a support cradle or a frame affixed to the apparatus.

The improvements that result therefrom in all of the cases are a better technicality and/or performance by the quality of the support induced by the dimension of the seating, a real versatility in the possibility of separating the boot from the sport apparatus for walking, and this without degrading the quality of the boot support on the corresponding element on account of the wear of the sole.

Figure 3:
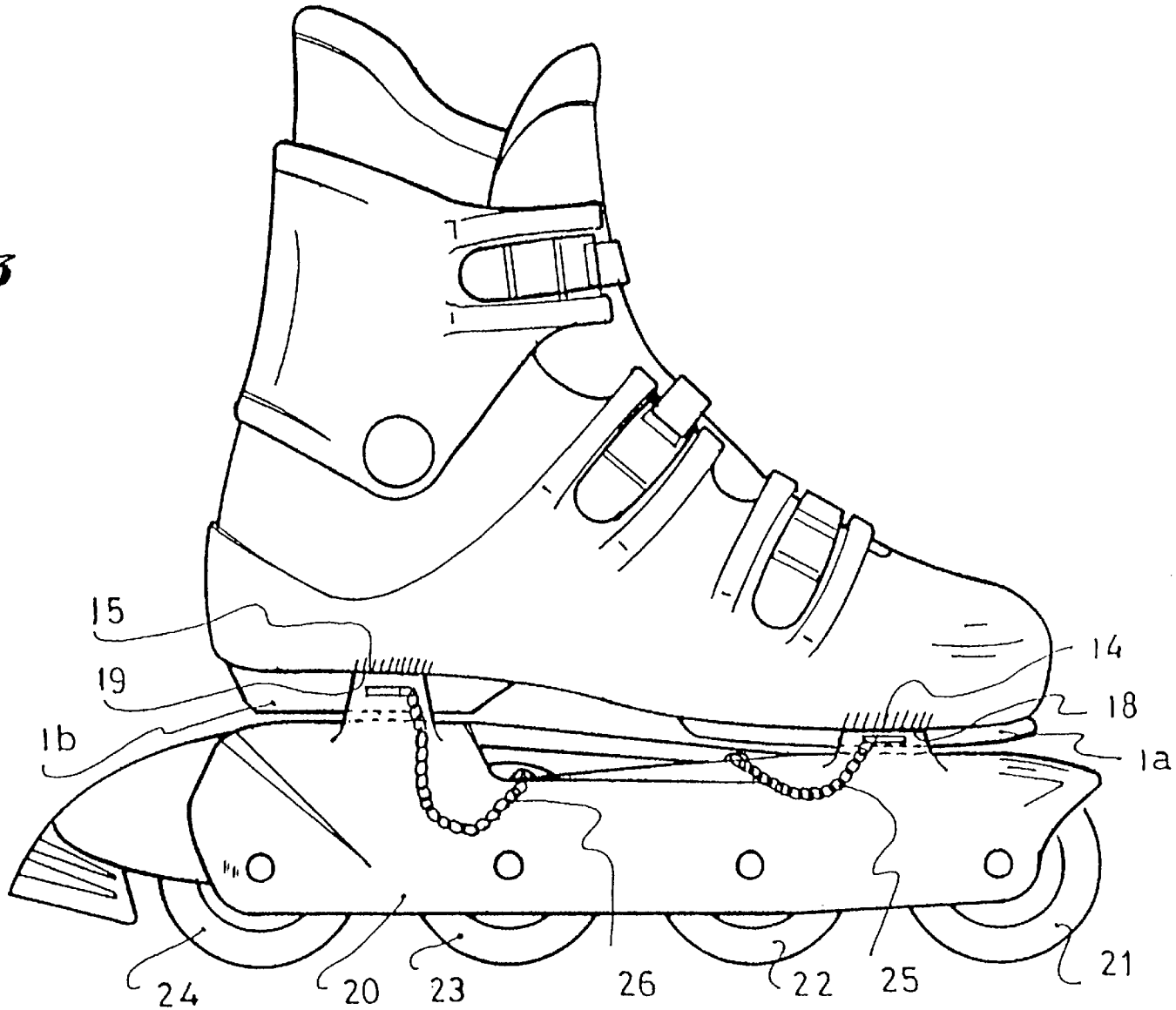
FIG. 3 shows a second embodiment of a boot according to the invention for skating with aligned wheels and the associated support device.

FIG. 3 shows an embodiment of such a boot according to the invention for in-line skating comprising a frame 20 equipped with aligned wheels 21–24. The frame is equipped with projections whose upper surfaces 18, 19 (16, 17 not shown) cooperate with support surfaces 12, 13 (14, 15) of the boot recessed from the sole formed of a front sole zone 1*a* and a heel sole zone 1*b*. In the embodiment shown, the elements for retaining the boot on the rolling frame are constituted of locking means 25 and 26 making a blockage of the projections with respect to the sole.

Other retaining means can be used and, in particular, a sufficiently rigid shell or a flexible envelope affixed to the frame, and equipped with buckle or lacing closing means, for example, closed on the walking boot, the boot being equipped with support surfaces for the projections so as to ensure good supports of the foot with respect to the apparatus.

The same structure can also be used for a boot adapted to snowboarding, the projections forming support surfaces corresponding to support surfaces recessed from the walking sole, extending from a cradle forming a part of a binding assembly mounted on the snowboard.

In these different embodiments, shown or not shown, the geometry of the support surfaces formed by the upper surfaces of the projections, and of the corresponding support surfaces recessed with respect to the useful surface of the walking sole is adapted so that the position of the foot in the boot with respect to the apparatus necessary to the athletic practice is optimized with respect to this practice, especially for the advancing, the tilting of the sole with respect to the horizontal or lateral tilting.

In the application to alpine skiing, it is possible to provide an adaptation for a transitory phase in which the boot equipped with its support surfaces, outside of the walking zone of the sole, would be nonetheless adapted to conventional retaining and support elements, by providing adaptation means that can take the form of two removable soles, one being consistent with the standard, and the other adapted to walking according to the invention.

Figure 4:
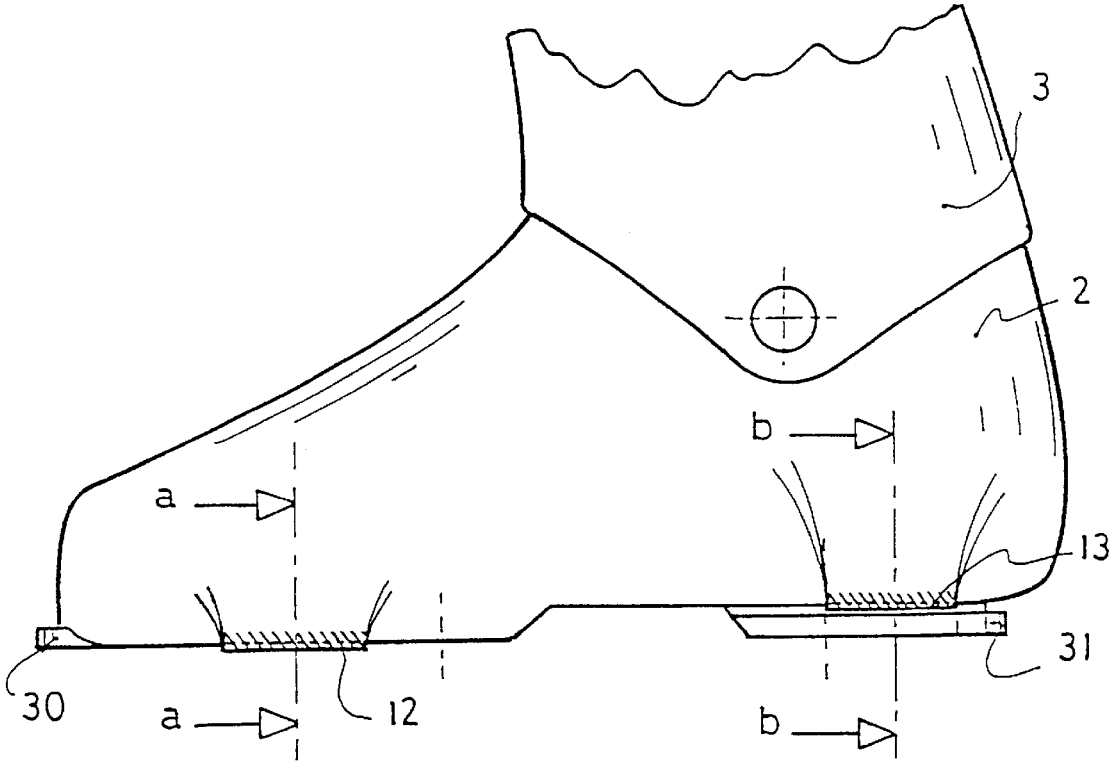
FIG. 4 shows a boot base according to FIG. 1 before the mounting of a sole.
Figure 5:
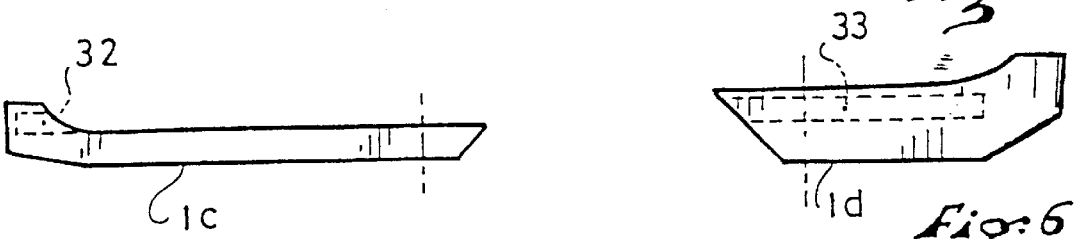
FIGS. 5 and 6 show, respectively, a normalized sole and a walking sole made of two parts, and ready for mounting on the base of the boot shown in FIG. 4.
Figure 6:
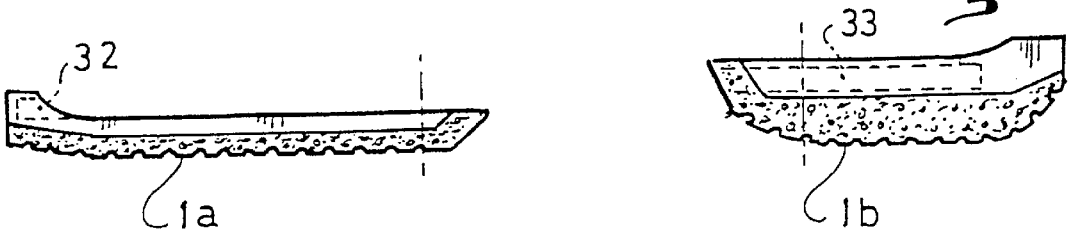

FIGS. 4, 5 and 6 show such an adaptation in lateral views.

FIG. 4 shows the boot without a sole, i.e., with its shell 2 and its upper 3, with the support surfaces 12, 13 (14, 15 not shown), adapted to cooperate with the projections extending from a cradle, formed on the shell base 2. These surfaces are as described with reference to FIGS. 1 and 2, arranged laterally with respect to the normalized central zone with a width "l" (FIG. 2). The front and rear parts of the shell base are equipped with protuberances 30 and 31 located on the longitudinal axis of the shell base.

This base is adapted to a conventional functioning when a sole 1*c*, 1*d*, equipped with a planar support surface consistent with the standards is attached thereto, as shown in FIG. 5, the front and rear parts of the sole being equipped with slides 32, 33, adapted to cooperate with complementary parts 30 and 31, arranged to this end in the shell base.

Conversely, this base is adapted for a functioning according to the invention, and the surfaces 12, 13 (14 and 15) play their part of a support when a walking sole 1*a*, 1*b* shown in FIG. 6 is attached thereto, equipped with the same slides 32, 33, for binding to the shell base which, in turn, is adapted for walking but cannot provide the necessary supports.

Figure 7A:
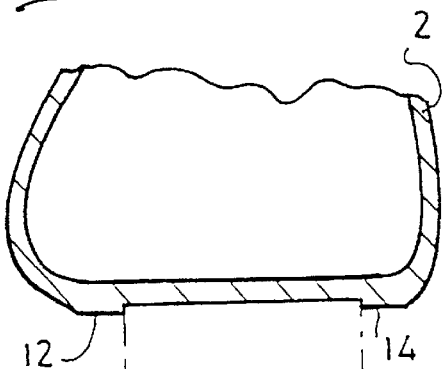
FIGS. 7*a*, 7*b*, 7*c*, and 8*a*, 8*b*, 8*c* show, respectively, vertical cross-sections along the lines "a" and "b" of FIG. 4, and show the mounting of a normalized or walking sole with respect to the supports 12, 14 and 13, 15, respectively.
Figure 7B:
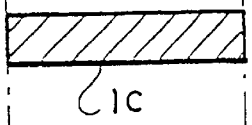
Figure 7C:
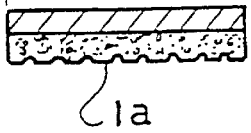

FIGS. 7*a*, 7*b*, 7*c* are transverse cross-sectional views corresponding to FIGS. 4, 5 and 6 along the vertical axis "a" of the forefoot.

Figure 8A:
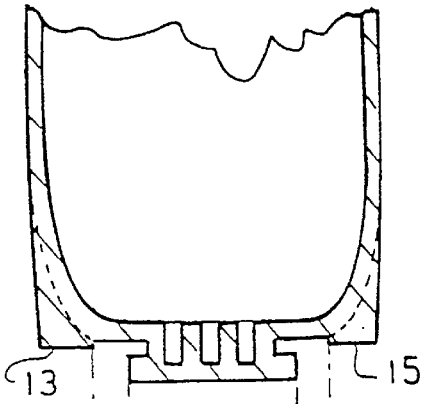
Figure 8B:
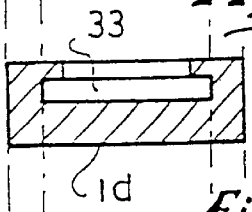
Figure 8C:
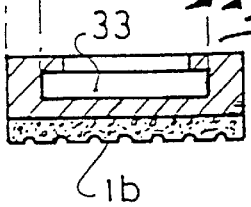

FIGS. 8*a*, 8*b* and 8*c* are transverse cross-sectional views corresponding to the same Figures at the level of the heel along the vertical axis "b," where the same references designate the same elements.

Figure 9:
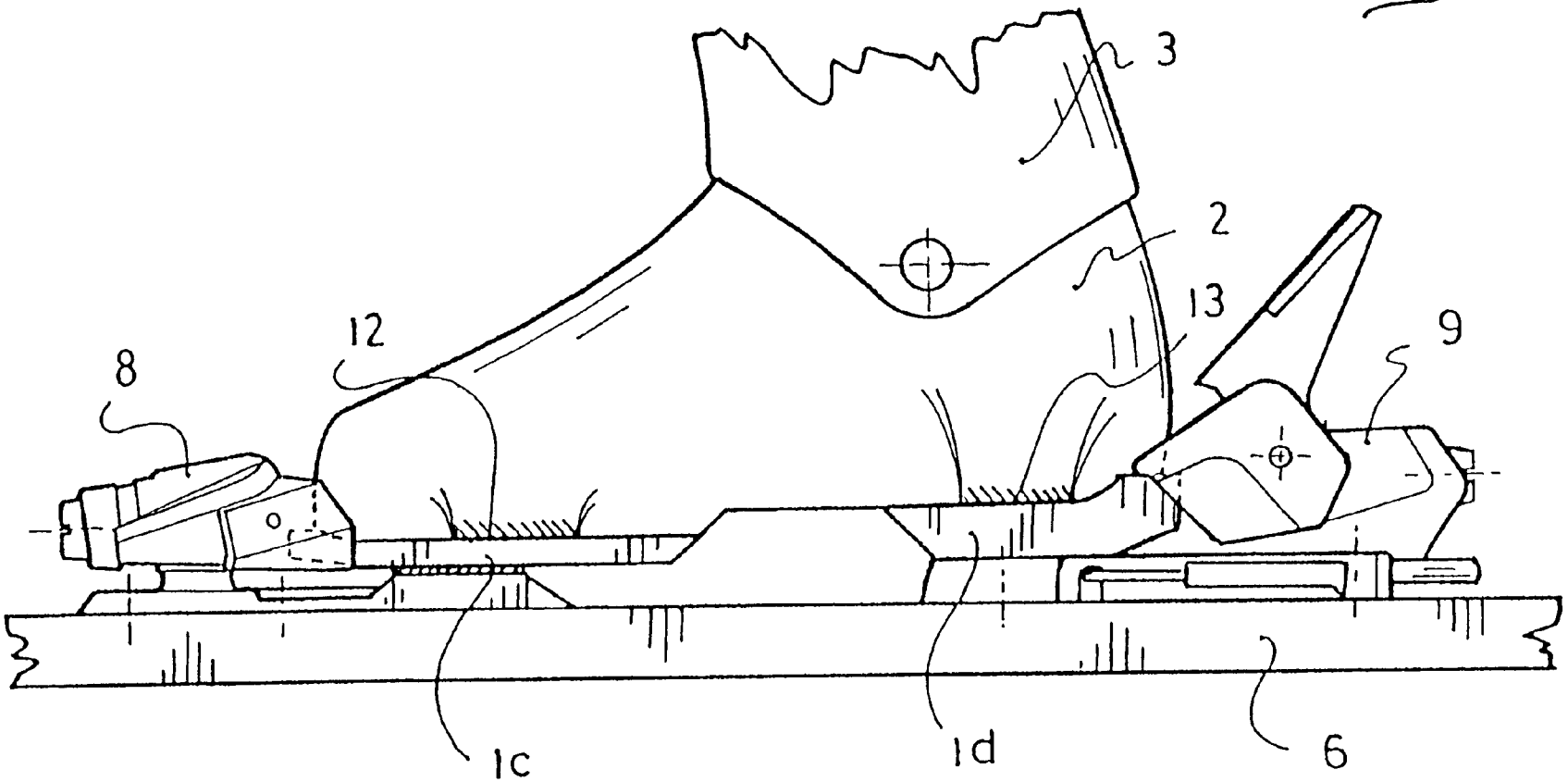
FIG. 9 shows a lateral view of a boot according to the invention, but equipped with a normalized sole and mounted on a ski by means of a conventional binding device, the assembly being consistent with the ISO 5355 standard.

FIG. 9 shows the boot equipped with the conventional sole on a ski on which it is held in a conventional manner, the support surfaces according to the invention 12, 13, 14 and not being used.

It was previously mentioned in relation to the description of the embodiment of the invention for alpine skiing, with reference to FIGS. 1 and 2, that the arrangement of the support surfaces plumb with the running edges allowed an improvement of the transmission.

Figure 10:
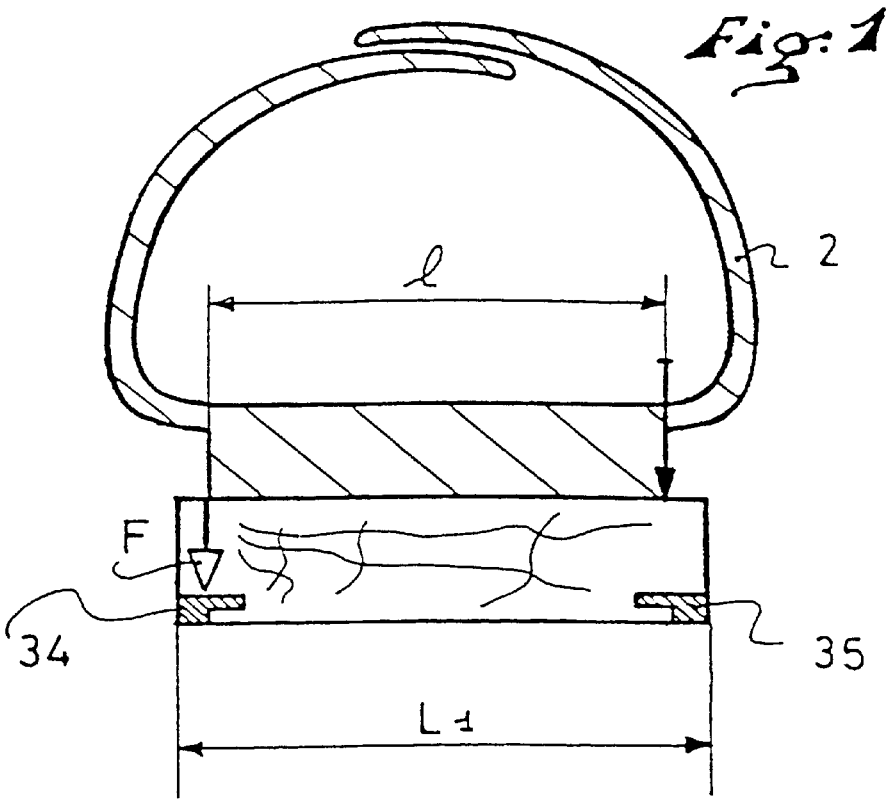
FIG. 10 shows a boot/ski assembly according to the prior art, in a cross-section at the level of the forefoot, for a "normal" width ski.

FIG. 10 shows a transverse cross-section of a "conventional" ski/boot assembly, "L1" being the width of this type of ski and "l" the normalized width of the boot sole.

It is seen that in the best of cases, with a new, therefore flat boot sole, the couple available for the edge setting is l/2×F, the dimensions "l" and "L1" being furthermore close enough to one another.

Figure 11:
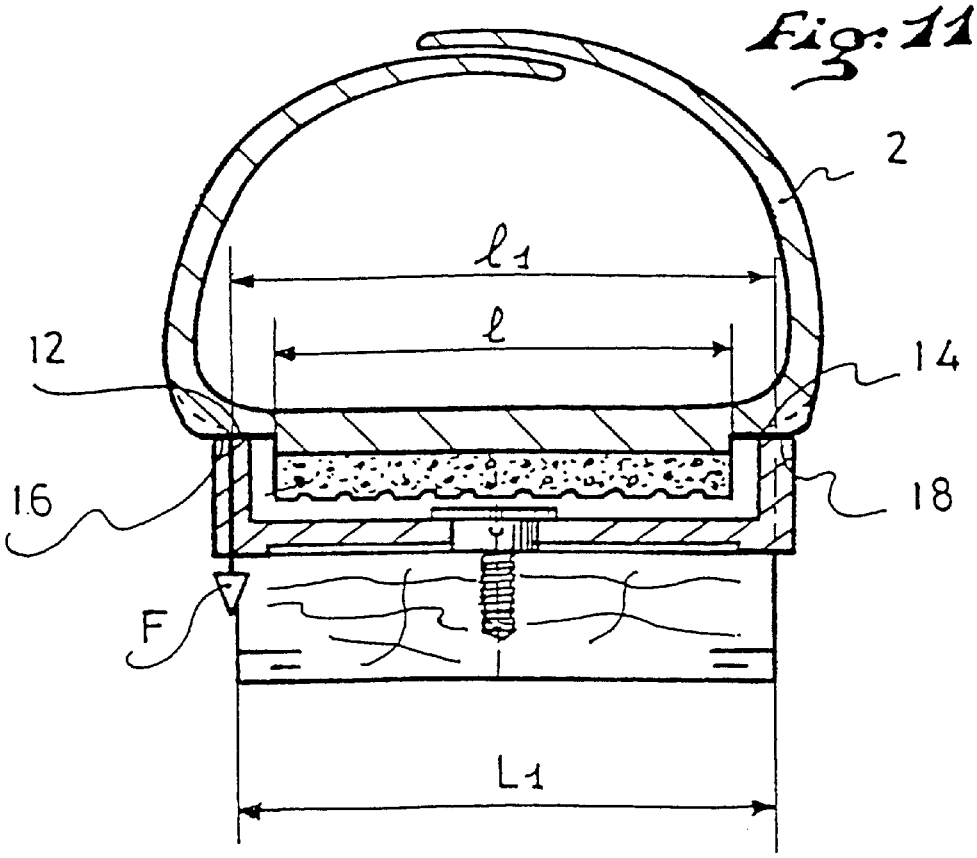
FIG. 11 shows the boot according to the invention cooperating with a "normal" ski (same as FIG. 10), with an associated support device.

FIG. 11 shows a transverse cross-section of a ski/boot assembly according to the invention, the ski being identical to that of FIG. 10 (width L1), and "l1" being the distance between supports greater than "l".

In this case, the couple l1/2×F available for the edge setting is more favorable and the transmission of forces from the skier to the ski is considerably improved. This would be even more evident if FIG. 10 had shown a sole curved from walking and wear.

Figure 12:
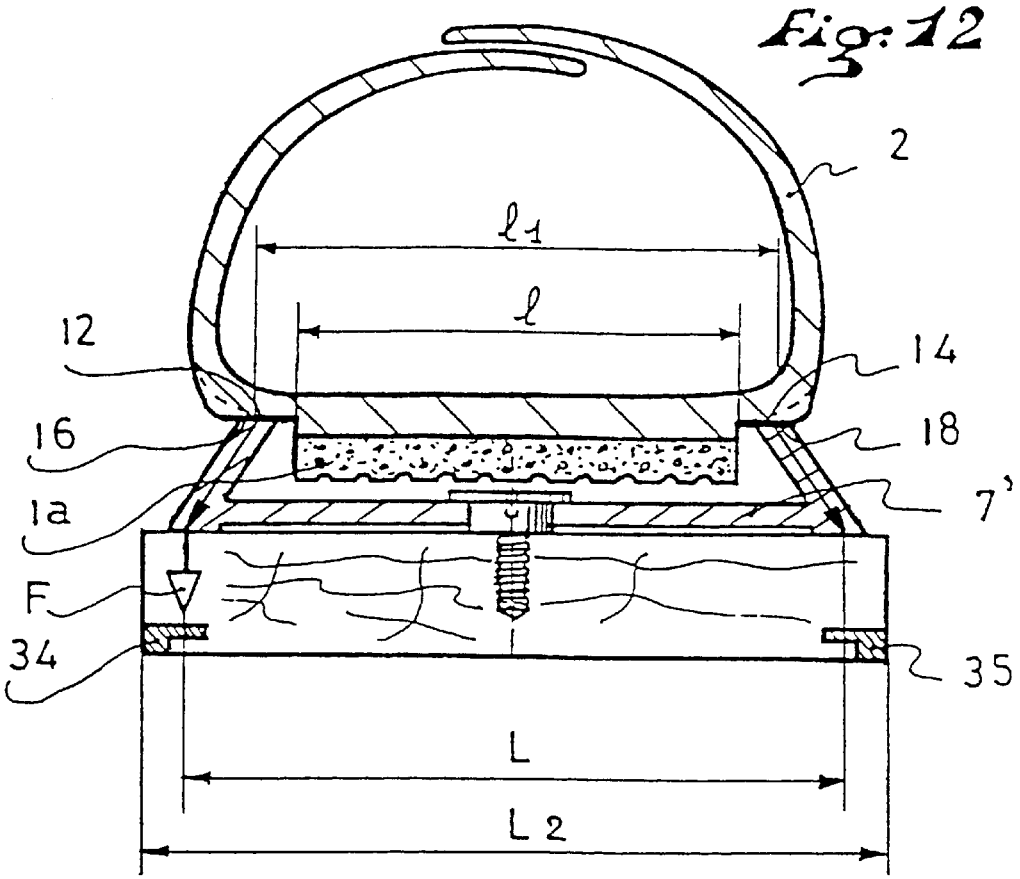
FIGS. 12 and 13 show, for a larger ski and for a narrower ski, a cross-section of a boot assembly according to the invention with an associated support device.

FIG. 12 shows a transverse cross-section similar to that of FIG. 11, but with a "wide" ski, of a width L2>L1.

It is known that, for skiing on powdery snow, other types of wider skis are used, and a problem encountered with conventional binding systems (support/retention) mounted on such skis is a lack of gripping on a hard trail. The boot according to the invention, cooperating with support surfaces extending from a cradle, according to the invention, is particularly well adapted to such a practice with a wide ski.

In this embodiment, the dimension "l1" defined by the supports 12, 14 (13 and 15 at the rear are not shown), is identical to that of FIG. 11.

However, the cradle 7' is trapezoidal and allows the transmission to the ski, through the supports 16, 18 (17, 19 not shown) of a couple L/2×F which is applied substantially at the level of the ski running edge (dimension L compared to L2). Thus, the use of a "wide" ski is no longer incompatible with a good efficiency on hard snow or trails.

This solution is particularly interesting since it avoids the drawbacks of a prior known solution consisting of, for improving the edge setting, off-centering the binding with respect to the longitudinal axis of the ski, thereby creating a right ski and a left ski, with a displacement of the center of gravity of the ski with respect to the boot, this imbalance being susceptible of causing a problem upon landing from a jump, for example, or simply affecting the maneuverability.

Figure 13:
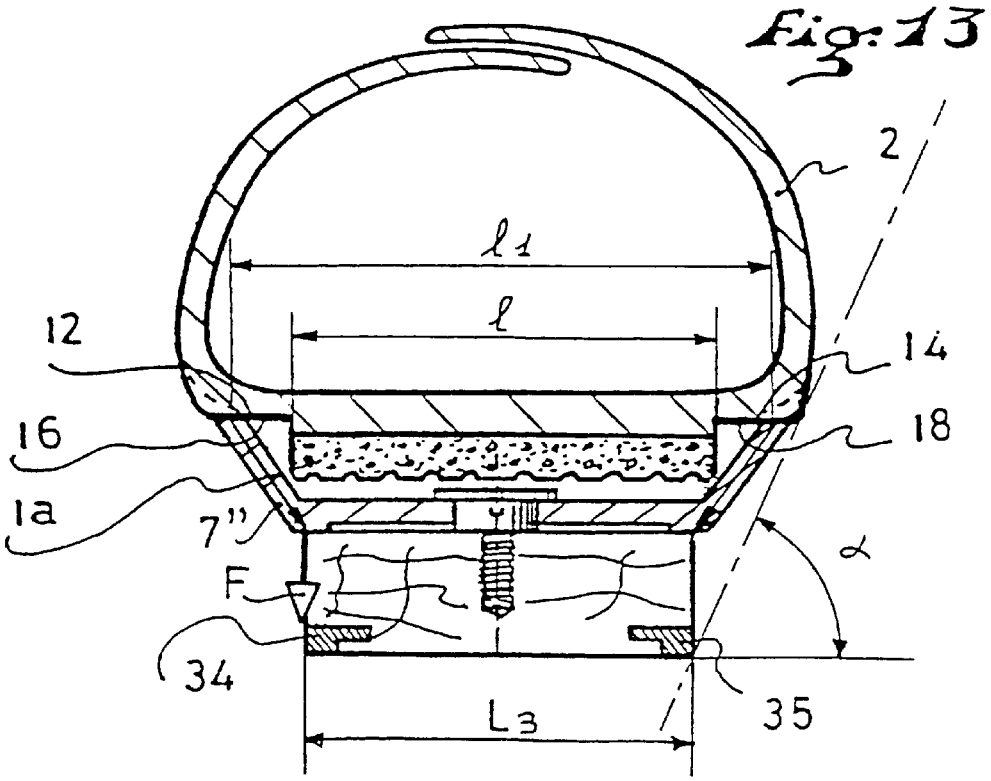

In the same way, there are other ski practices in which the ends of the ski are wide whereas the central part is narrower, and which is particularly adapted to making curves. The invention is also particularly well adapted to this type of practice. In this case, the trapezium formed in cross-section by the cradle 7", as shown in FIG. 13, is inverted with respect to that shown in FIG. 12, the sole of the boot still being the same. The width "l1" between the support surfaces being greater than the width L3 of the ski, the transmission of forces occurs through the tilted planes of the support cradle 7". This tilting associated with the raising of the boot does not penalize the edge setting angle (angle $\alpha$).

The invention is not limited to the embodiments described and/or shown.

In particular, the shape of the frame or of the cradle from which extend the projections whose upper surfaces form the support surfaces for corresponding surfaces provided on the base of the boot recessed from the walking sole will be adapted to the athletic practice and to the shape of the corresponding gliding apparatus, and it could or could not include other functions necessary for this practice, especially all or part of the means for binding the boot on the apparatus. In any case, the boot/gliding apparatus interface and the boot/ground interface when walking are separate, and the quality of the first is conserved regardless of the state of the second one.

What is claimed is:

1. A boot for a gliding sport, said boot comprising:

a rigid shell base and an upper adapted to be supported and retained on a gliding apparatus, said base comprising a sole, said sole having a walking surface and a plurality of support surfaces recessed above and laterally of said walking surface, said support surfaces being adapted to be supported on upper surfaces of projections extending from the gliding apparatus, the boot furthermore comprising retention structure adapted to cooperate with complementary binding devices fixed to the gliding apparatus.

2. A boot according to claim 1, wherein:

said support surfaces define a support plane.

3. A boot according to claim 2, wherein:

said support plane is inclined with respect to a horizontal plane of the gliding apparatus.

4. A boot according to claim 2, wherein:

said support surfaces of said shell base are formed by cleats made by molding integrally with said rigid shell base.

5. A boot according to claim 3, wherein:

said support surfaces of said shell base are formed by cleats made by molding integrally with said rigid shell base.

6. A boot according to claim 1, wherein:

said walking surface is a lowermost surface shaped to facilitate walking.

7. A boot according to claim 6, wherein:

said support surfaces of said shell base are formed by cleats made by molding integrally with said rigid shell base.

8. A boot according to claim 1, wherein:

said walking sole comprises a removable walking sole, said boot further comprising a replaceable normalized sole for an athletic practice in which the gliding apparatus requires a sole constituting a normalized interface.

9. A boot according to claim 8, wherein:

said support surfaces of said shell base are formed by cleats made by molding integrally with said rigid shell base.

10. A boot according to claim 1, wherein:

said support surfaces of said shell base are formed by cleats made by molding integrally with said rigid shell base.

11. A boot according to claim 1, wherein:

said retention structure comprise retaining surfaces positioned at respective upper portions of front and rear zones of said sole to cooperate with front and rear binding elements, respectively.

12. A gliding apparatus comprising:

a frame or cradle adapted to cooperate with a removable boot according to claim 1;

detachable retention devices to hold the boot on the apparatus;

upwardly extending projections having surfaces defining a support plane for engagement with the support surfaces of the boot, said surfaces of said upwardly extending projections being separate from the sole of the boot.

13. A snow gliding apparatus comprising:

a gliding element equipped with retention devices adapted to cooperate with at least one boot according to claim 1;

said gliding element further equipped with a cradle, said cradle comprising projections having upper surfaces defining a support plane for the boot, said cradle having a base fixed to the gliding apparatus to transmit the boot supports to the apparatus.

14. A snow gliding apparatus according to claim 13, wherein:

a cross section of said cradle is substantially rectangular for a support width on the gliding apparatus having the same dimension as the width between support zones formed on the shell base of the boot, recessed from the walking surface of the boot.

15. A snow gliding apparatus according to claim 13, wherein:

the gliding apparatus has a width greater than a width of the sole of the boot, a cross section of said cradle being trapezoidal with widths between said projections being substantially less than corresponding widths of said base of said cradle.

16. A snow gliding apparatus according to claim 13, wherein:

the gliding apparatus has a width smaller that a width of the sole of the boot at said front and rear projections, a cross section of said cradle being trapezoidal with widths between said projections being substantially greater than corresponding widths of said base of said cradle.

17. A snow gliding apparatus according to claim 13, further comprising:

a mechanism for mounting said cradle for rotation on said gliding element for enabling cooperation with a releasable safety binding system.

18. A snow gliding apparatus according to claim 13, wherein:

said mechanism provides for rotation about an upwardly extending pivot axis, said pivot axis being positioned between the calcaneus and first metatarsal of a user's foot when positioned on the gliding apparatus.

19. A snow gliding apparatus according to claim 17, wherein:

said releasable safety binding system is at least partially affixed to said cradle.

20. An assembly comprising:

a boot for a gliding sport and a structure for which a gliding apparatus is equipped for securing said boot to the gliding apparatus;

said boot comprising a rigid shell base and an upper adapted to be supported and retained on a gliding apparatus, said base comprising a sole, said sole having a walking surface and a plurality of support surfaces recessed above and laterally of said walking surface, said support surfaces defining a support plane, said support surfaces being adapted to be supported on upper surfaces of projections extending from the gliding apparatus, the boot furthermore comprising retention structure; and said structure for which the gliding apparatus is equipped comprises upwardly extending projections having surfaces defining a support plane for engagement with the support surfaces of the boot, said surfaces of said upwardly extending projections being separate from the sole of said boot, and binding devices complementary of said retention structure of said boot to hold said boot on said gliding apparatus.

21. An assembly according to claim 20, further comprising said gliding apparatus.

22. An assembly according to claim 21, wherein said gliding apparatus comprises a ski.

23. An assembly according to claim 22, wherein said boot comprises an alpine ski boot.

24. An assembly according to claim 21, wherein said gliding apparatus comprises a skate frame with in-line wheels.

* * * * *